US012546540B2

(12) United States Patent
Shin

(10) Patent No.: US 12,546,540 B2
(45) Date of Patent: Feb. 10, 2026

(54) HEAT EXCHANGER

(71) Applicant: Hanon Systems, Daejeon (KR)

(72) Inventor: Sung Hong Shin, Daejeon (KR)

(73) Assignee: HANON SYSTEMS (KR)

( * ) Notice: Subject to any disclaimer, the term of this patent is extended or adjusted under 35 U.S.C. 154(b) by 283 days.

(21) Appl. No.: 18/038,787

(22) PCT Filed: Feb. 14, 2022

(86) PCT No.: PCT/KR2022/002129

§ 371 (c)(1),
(2) Date: May 25, 2023

(87) PCT Pub. No.: WO2022/177240

PCT Pub. Date: Aug. 25, 2022

(65) Prior Publication Data

US 2023/0417490 A1 Dec. 28, 2023

(30) Foreign Application Priority Data

Feb. 22, 2021 (KR) ..... 10-2021-0023343

(51) Int. Cl.
*F28D 9/00* (2006.01)

(52) U.S. Cl.
CPC ..... *F28D 9/0062* (2013.01); *F28D 9/005* (2013.01)

(58) Field of Classification Search
CPC .... F28F 3/025; F28F 3/027; F28F 3/06; F28F 3/02; F28F 2270/00; F28D 9/005; F28D 9/0043; F28D 9/00
See application file for complete search history.

(56) References Cited

U.S. PATENT DOCUMENTS 7,255,159 B2 * 8/2007 Sagasser ..... F28D 9/005 165/146
2010/0084120 A1 4/2010 Yin et al.
2014/0060789 A1 * 3/2014 Rousseau ..... F28F 3/025 165/166

FOREIGN PATENT DOCUMENTS

DE 19519312 A1 11/1996
DE 19547185 A1 * 6/1997 ..... F28D 9/0056
DE 202016002578 U1 * 8/2017 ..... F01M 5/002
DE 10 2018 120 965 A1 2/2019
(Continued)

OTHER PUBLICATIONS

Office Action issued on Jul. 8, 2024 by the German Patent Office in the corresponding Patent Application No. DE 11 2022 000 434.7, with English translation.

*Primary Examiner* — Jianying C Atkisson
*Assistant Examiner* — For K Ling
(74) *Attorney, Agent, or Firm* — NORTON ROSE FULBRIGHT US LLP

(57) ABSTRACT

A heat exchanger according to the present invention includes plates each having, at one side thereof, an inlet port into which a fluid is introduced, and a first junction port having a periphery protruding upward, and having, at the other side thereof, an outlet port from which the fluid is discharged, and a second junction port having a periphery protruding upward, and a heat dissipation fin seated on an upper surface of the plate and having at least one non-heat dissipation fin portion formed by cutting a predetermined region of the heat dissipation fin in a direction parallel to a direction from one side to the other of the plate, in which the heat dissipation fin may be inserted between the pair of stacked plates.

19 Claims, 11 Drawing Sheets

(56) References Cited

FOREIGN PATENT DOCUMENTS

| | | | | | |
|---|---|---|---|---|---|
| EP | 3546257 | A1 | * | 10/2019 | ..... B60H 1/32281 |
| JP | H08159684 | A | * | 6/1996 | ..... F28D 9/0093 |
| JP | 2002257488 | A | * | 9/2002 | |
| JP | 2011-108891 | A | | 6/2011 | |
| JP | 6091601 | B2 | | 3/2017 | |
| JP | 2018009460 | A | | 1/2018 | |
| KR | 101206858 | B1 | | 12/2012 | |
| KR | 2017-0113980 | A | | 10/2017 | |
| KR | 20190023263 | A | * | 3/2019 | ..... F25B 40/02 |
| KR | 2020-0011163 | A | | 2/2020 | |
| WO | WO-2020009157 | A1 | * | 1/2020 | ..... H05K 7/20254 |

* cited by examiner (a)

(b)

(a)

(b)

HEAT EXCHANGER

CROSS REFERENCE TO RELATED APPLICATIONS

This application is a national phase under 35 U.S.C. § 371 of International Application No. PCT/KR2022/002129 filed on Feb. 14, 2022, which claims the benefit of priority from Korean Patent Application No. 10-2021-0023343 filed on February 22. 2021. The entire contents of these applications are incorporated herein by reference in their entirety.

TECHNICAL FIELD

The present invention relates to a heat exchanger, and more particularly, to a heat exchanger having a bypass flow path formed to prevent a pressure loss of a fluid flowing in a plate.

BACKGROUND ART

In general, a heat exchanger refers to a device designed to allow two or more fluids to exchange heat with one another. The heat exchanger is used to allow different fluids to exchange heat with one another so that the fluids are cooled or heated. Representatively, the heat exchanger is applied to a vehicle cooling/heating system, a refrigerator, an air conditioner, and the like.

In general, a plate-shaped heat exchanger, which is applied to the vehicle cooling/heating system, has a passageway formed between plates each having a predetermined thickness so that a fluid flows through the passageway. The plate-shaped heat exchanger is characterized in that a plurality of plates is disposed at predetermined intervals so that different fluids alternately flow through passageways between the plurality of plates.

With reference to Korean Patent Application Laid-Open No. 10-2020-0011163, as illustrated in FIG. 1, a water-cooled condenser 1, which is one of heat exchangers, may have a plurality of plates 10 stacked to define a flow section through which fluids flow.

With reference to Korean Patent No. 10-1206858, as illustrated in FIG. 2, a plate shape heat exchange unit 30 in the related art may include a fluid inlet/outlet part including a first fluid inlet port 11, a first fluid outlet port 12, a second fluid inlet port 21, and a second fluid outlet port 22. Further, a first pressure reinforcement structure 41 and a second pressure reinforcement structure 42 may be provided in a region adjacent to the fluid inlet/outlet part. The heat exchange unit may include a plate 51, and a chevron part 50 configured to dissipate heat from a fluid while exchanging heat with the fluid.

That is, the plate-shaped heat exchanger in the related art uses heat dissipation members such as the chevron part or a heat dissipation fin to dissipate heat from the fluid flowing between the plates. In case that the chevron part and the heat dissipation fin are used, heat dissipation performance of the heat exchanger is improved. However, in case that a shape of the chevron part or heat dissipation fin is perpendicular to a flow of the fluid, there sometimes occurs an adverse effect that causes an excessive loss of pressure of the fluid.

DOCUMENTS OF RELATED ART

Patent Documents

Korean Patent Application Laid-Open No. 10-2020-0011163 (published on Feb. 3, 2020)

Korean Patent No. 10-1206858 (registered on Nov. 26, 2012)

DISCLOSURE

Technical Problem

The present invention has been made in an effort to solve the above-mentioned problem, and an object of the present invention is to provide a heat exchanger in which a partial region of a heat dissipation fin inserted into stacked plates is cut, which makes it possible to prevent a pressure loss of a fluid flowing in the stacked plates.

Technical Solution

A heat exchanger according to the present invention may include: plates each having an inlet port into which a fluid is introduced, and an outlet port from which the fluid is discharged; and a heat dissipation fin inserted between a pair of plates, in which the inlet port and the outlet port are formed at one side based on a width direction of a plate and spaced apart from each other in a longitudinal direction of the plate, in which the heat dissipation fin includes a non-heat dissipation fin portion formed at the other side based on the width direction of the plate, and in which a heat exchanger core is formed by stacking a plurality of plates.

Further, the non-heat dissipation fin portion may be formed by cutting a part of the heat dissipation fin.

Further, the plate may include: a first junction port having a periphery protruding upward; and a second junction port having a periphery protruding upward, and the first junction port and the second junction port may be formed at the other side based on the width direction of the plate and spaced apart from each other in the longitudinal direction of the plate.

In this case, the heat dissipation fin may have holes formed to correspond to the inlet port, the outlet port, the first junction port, and the second junction port and be seated on an upper surface of the plate.

Further, the non-heat dissipation fin portion may be formed within a maximum distance range between an outer diameter of the first junction port and an outer diameter of the second junction port and positioned at an edge of the heat dissipation fin.

Further, the non-heat dissipation fin portion may be formed to include a point farthest in distance from both the inlet port and the outlet port.

Further, a cut start point of the non-heat dissipation fin portion may be positioned at a point corresponding to an outer diameter range of the first junction port, and an outer diameter based on a direction parallel to a direction from one side to the other of the plate may be applied to the outer diameter range.

Further, a cut end point of the non-heat dissipation fin portion may be positioned at a point corresponding to an outer diameter range of the second junction port, and the outer diameter based on a direction parallel to the direction from one side to the other of the plate may be applied to the outer diameter range.

Further, the non-heat dissipation fin portion may have a width of 1 to 1.5 mm in a direction from an edge to the inside of the heat dissipation fin.

Further, in the non-heat dissipation fin portion, a cut width of a central portion may be larger than a cut width of a cut start point and a cut width of a cut end point.

Further, in the non-heat dissipation fin portion, a cut width of a cut start point and a cut width of a cut end point may be different from each other.

In this case, in the non-heat dissipation fin portion, the cut width may increase in a direction from the cut start point to the cut end point.

In addition, in the non-heat dissipation fin portion, the cut width may decrease in a direction from the cut start point to the cut end point.

A heat exchanger according to the present invention, wherein a coolant flows through the heat exchanger core, and the heat exchanger further includes: a receiver dryer; and a connector configured to connect the heat exchanger core and the receiver dryer.

Advantageous Effects

With the above-mentioned configuration, the heat exchanger according to the present invention may maintain maximum performance in dissipating heat from the fluid flowing through the space defined by stacking the pair of plates and minimize a pressure loss caused by an increase in flow path of the fluid due to the shape of the heat dissipation fin.

EXPLANATION OF REFERENCE NUMERALS AND SYMBOLS

Figure 1:
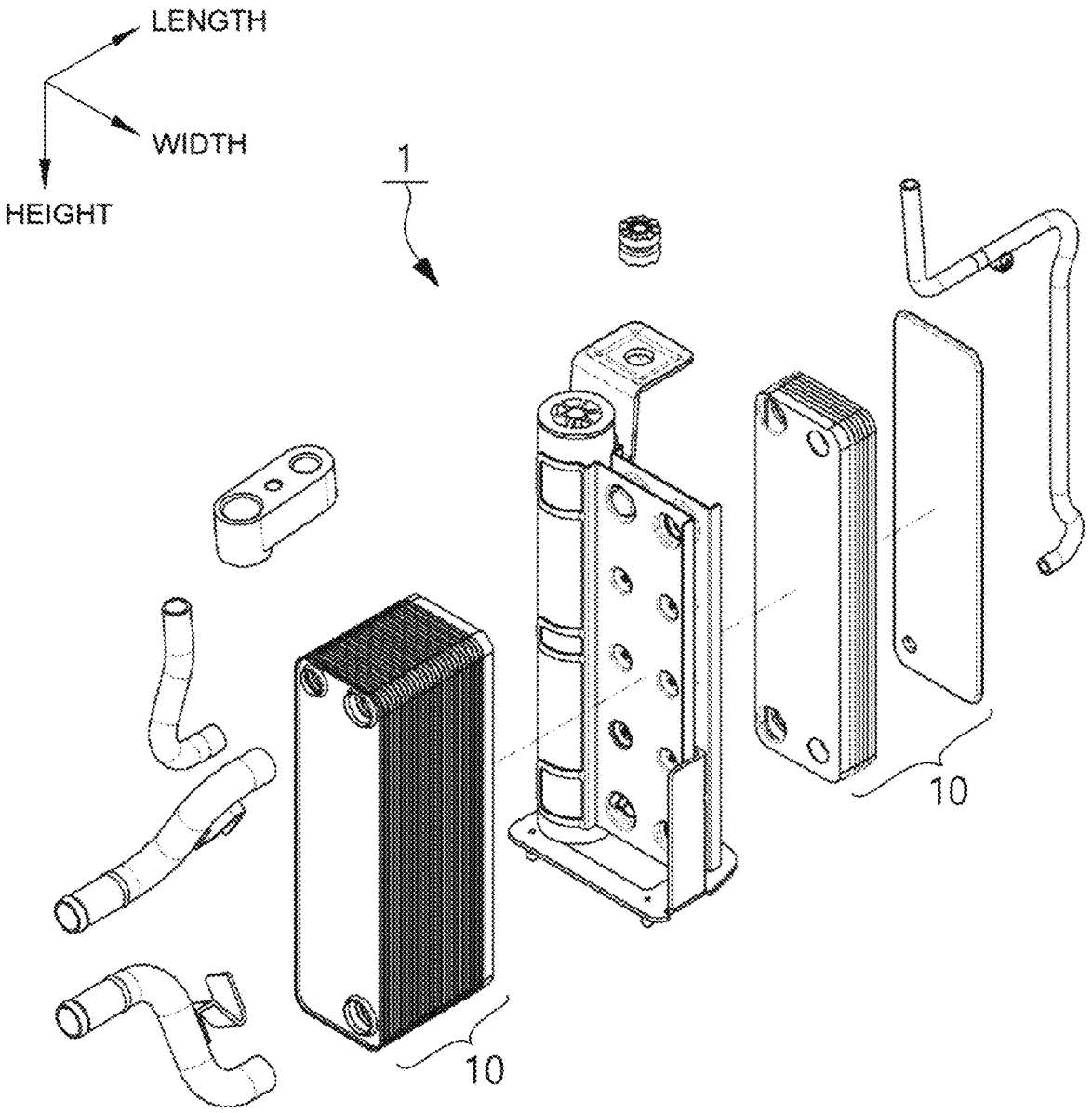
Fig. 1 (prior art)
FIG. 1 is an exploded perspective view of a water-cooled condenser in the related art.
Figure 2:
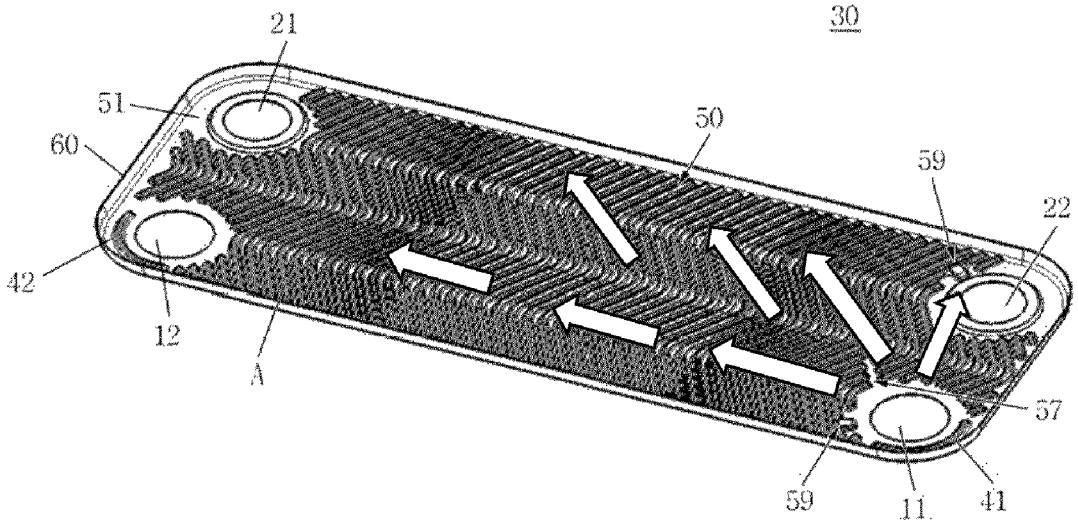
FIG. 2 is a perspective view of a heat exchanger plate in the related art.

1000: Water-cooled condenser
1100: Heat exchanger core
1200: Receiver dryer
1300: Connector
1400*a*: Bracket
1400: Bracket plate
1410: Fixing plate part
1411: Plate surface portion
1412: Peripheral portion
1420: Connection plate part
1500: Reinforcement plate
100: Plate
100*a*: Lower plate
100*b*: Upper plate
110: Inlet port
120: Outlet port
130: First junction port
140: Second junction port
200: Heat dissipation fin
210: Non-heat dissipation fin portion
220: Hole
A: Outer diameter range
B: Cut width
S: Cut start point
E: Cut end point
C: Central portion
P1: First point
P2: Second point

Best Mode

Hereinafter, the technical spirit of the present invention will be described in more detail using the accompanying drawings. In addition, terms or words used in the specification and the claims should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method. Therefore, the exemplary embodiments disclosed in the present specification and the configurations illustrated in the drawings are just the best preferred exemplary embodiments of the present invention and do not represent all the technical spirit of the present invention. Accordingly, it should be appreciated that various modified examples capable of substituting the exemplary embodiments may be made at the time of filing the present application.

Hereinafter, the technical spirit of the present invention will be described in more detail using the accompanying drawings. The accompanying drawings are only exemplary embodiments illustrated to explain the technical spirit of the present invention in more detail, and the technical spirit of the present invention is not limited to the form of the accompanying drawings.

Figure 3:
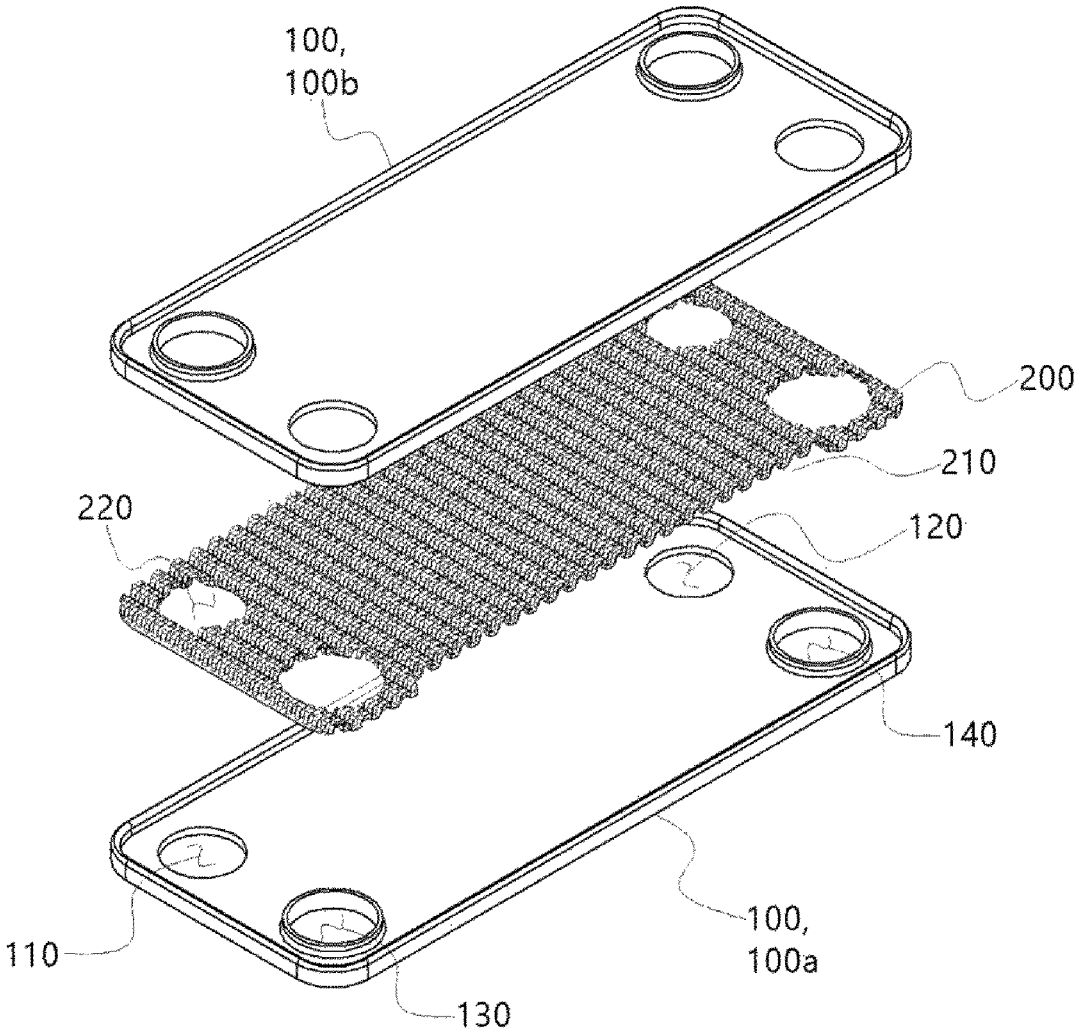
FIG. 3 is an exploded perspective view illustrating stacked plates and a heat dissipation fin according to the present invention.
Figure 4:
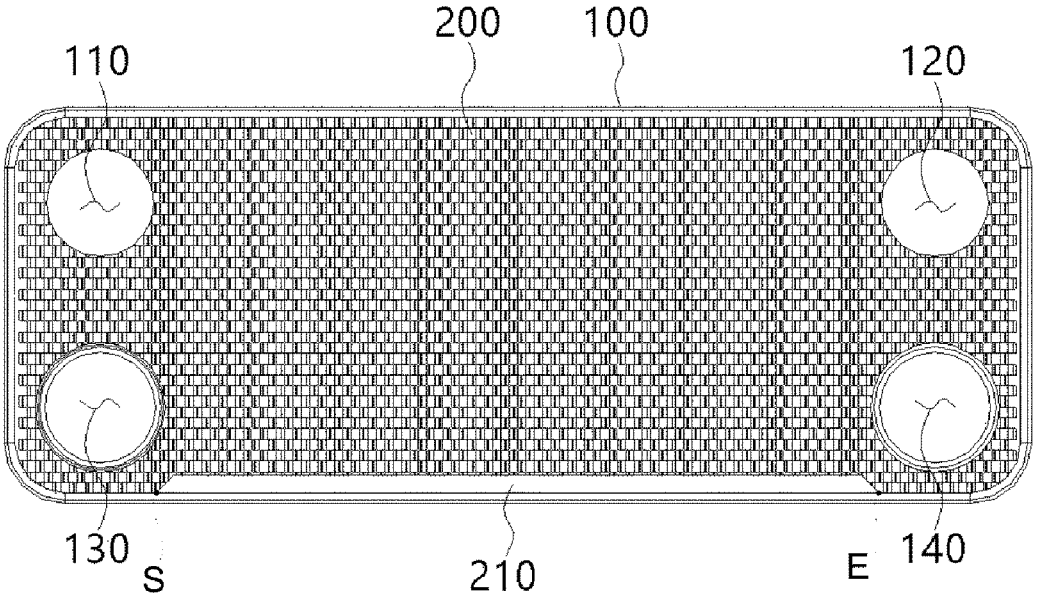
FIG. 4 is an assembled top plan view illustrating a plate and a heat dissipation fin according to a first embodiment of the present invention.

With reference to FIGS. 3 and 4, a heat exchanger according to the present invention may include: plates 100 each having an inlet port 110 into which a fluid is introduced, and an outlet port 120 from which the fluid is discharged; and a heat dissipation fin 200 inserted between a pair of plates 100*a* and 100*b*. The inlet port 110 and the outlet port 120 may be formed at one side based on a width direction of a plate 100 and spaced apart from each other in a longitudinal direction of the plate 100. The heat dissipation fin 200 may include a non-heat dissipation fin portion 210 formed at the other side based on the width direction of the plate 100. A plurality of plates 100 may be stacked to define a heat exchanger core.

The fluid, which flows through a space defined by stacking the pair of plates 100*a* and 100*b*, may be oil or a coolant. However, the type of fluid is not limited. The fluid may be introduced into the inlet port 110, flow through the space between the pair of plates 100*a* and 100*b*, and be discharged to the outlet port 120. A partition wall is formed around the plate 100 to prevent the fluid from leaking to the outside of the plate 100.

The heat dissipation fin 200 has a shape in which structures horizontal with respect to a flow direction of the fluid and structures perpendicular to the flow direction of the fluid are repeatedly coupled, thereby improving an effect of dissipating heat from the fluid flowing through the space between the pair of plates 100*a* and 100*b*.

The non-heat dissipation fin portion 210 may be formed by cutting a part of the heat dissipation fin 200 and provided at the other side based on the width direction of the plate 100.

In addition, the plate 100 may include a first junction port 130 having a periphery protruding upward, and a second junction port 140 having a periphery protruding upward. The first junction port 130 and the second junction port 140 may be formed at the other side based on the width direction of the plate 100 and spaced apart from each other in the longitudinal direction of the plate 100.

As illustrated in FIG. 4, the pair of plates 100*a* and 100*b* may be stacked such that the second junction port 140 of the upper plate 100*b* is positioned above the inlet port 110 of the lower plate 100*b*, the first junction port 130 of the upper plate 100*b* is positioned above the outlet port 120 of the lower plate 100*b*, the outlet port 120 of the upper plate 100*b* is positioned above the first junction port 130 of the lower plate 100*b*, and the inlet port 110 of the upper plate 100*b* is positioned above the second junction port 140 of the lower plate 100*b*.

In case that the pair of plates 100*a* and 100*b* is stacked, the peripheries of the first and second junction ports 130 and 140 protrude and thus are physically separated from the space between the inlet port 110, the outlet port 120, and the pair of plates 100*a* and 100*b*. The heat dissipation fin 200 is inserted into the space between the pair of plates 100*a* and 100*b*, such that a position of the heat dissipation fin 200 is fixed.

Furthermore, the heat dissipation fin 200 may have holes 220 formed to correspond to the inlet port 110, the outlet port 120, the first junction port 130, and the second junction port 140 and be seated on an upper surface of the plate 100. That is, the heat dissipation fin 200 may be seated on the upper surface of the plate 100 and have the holes 220 corresponding in sizes and positions to the inlet port 110, the outlet port 120, the first junction port 130, and the second junction port 140 formed in the plates 100. Therefore, it is possible to minimize hindrance to the flow of the fluid, improve overall performance in dissipating heat from the fluid, and prevent a deterioration in coupling force between the pair of plates 100*a* and 100*b*.

A flow distance of the fluid is increased by the shape of the heat dissipation fin 200 having the structure perpendicular to the flow direction, which may cause a pressure loss. Therefore, to minimize the pressure loss, the heat dissipation fin 200 according to the present invention includes the non-heat dissipation fin portion 210 so that the fluid may bypass the heat dissipation fin 200 and move toward the outlet port 120 without receiving resistance.

In this case, the non-heat dissipation fin portion 210 is formed by cutting a part of the heat dissipation fin 200. The non-heat dissipation fin portion 210 refers to a space formed by machining (cutting) a part of the heat dissipation fin 200 or bending a part of the heat dissipation fin 200 in a direction perpendicular to a direction of a surface of the heat dissipation fin 200 so that the heat dissipation fin 200 is not formed.

Therefore, the heat exchanger according to the present invention may maintain maximum performance in dissipating heat from the fluid flowing through the space defined by stacking the pair of plates 100*a* and 100*b* and minimize a pressure loss caused by an increase in flow path of the fluid due to the shape of the heat dissipation fin 200.

With reference to FIG. 4, in the present invention, a straight line, which connects a center of the inlet port 110 and a center of the outlet port 120, may be parallel to a straight line that connects a center of the first junction port 130 and a center of the second junction port 140. That is, the center of the inlet port 110 and the center of the outlet port 120 may be positioned on the same straight line, and the center of the first junction port 130 and the center of the second junction port 140 may also be positioned on the same straight line. The two straight lines may be parallel to each other, and the two straight lines may be parallel to a direction from one side to the other of the plate 100.

In addition, the non-heat dissipation fin portion 210 may be formed within a maximum distance range between an outer diameter of the first junction port 130 and an outer diameter of the second junction port 140 and provided at an edge of the heat dissipation fin 200. That is, two opposite ends (a cut start point and a cut end point) of the non-heat dissipation fin portion 210 may be positioned within the maximum distance range between the outer diameter of the first junction port 130 and the outer diameter of the second junction port 140 and provided at an edge, i.e., a rim of the heat dissipation fin 200. The edge of the heat dissipation fin 200 is a region in which the hindrance to the flow of the fluid caused by the heat dissipation fin 200 is lowest, and a flow velocity of the fluid is highest. Therefore, when the non-heat dissipation fin portion 210 is positioned at the edge of the heat dissipation fin 200, the flow of the fluid, which is hindered by the heat dissipation fin 200, may bypass the heat dissipation fin 200, such that the flow velocity of the fluid, which bypasses the heat dissipation fin 200, may be maximized, thereby minimizing a pressure loss.

In this case, the non-heat dissipation fin portion 210 may include a point farthest in distance from both the inlet port 110 and the outlet port 120. That is, the non-heat dissipation fin portion 210 may include a point, on the heat dissipation fin 200, farthest in distance from the inlet port 110 and the outlet port 120, i.e., a point between a protruding portion of the first junction port 130 and a protruding portion of the second junction port 140. Therefore, the non-heat dissipation fin portion 210 may be positioned in a region, in which a highest degree of hindrance is applied to the flow of the fluid, and allow the fluid to bypass the heat dissipation fin 200, thereby effectively preventing a pressure loss.

Figure 5:
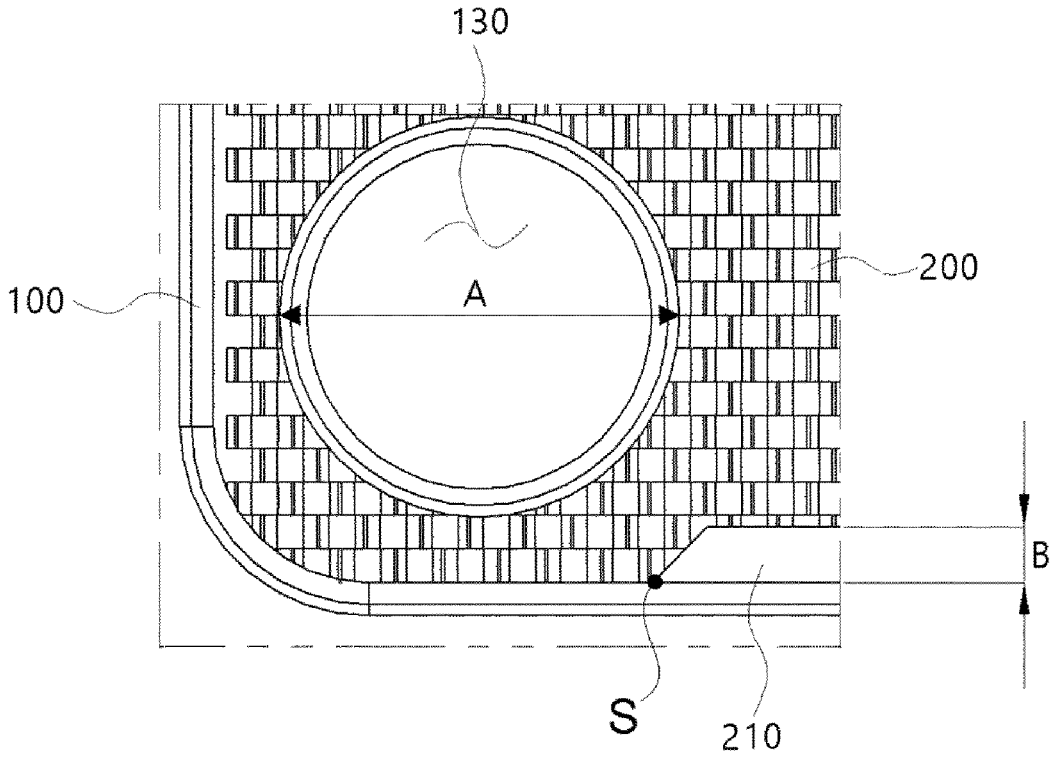
FIG. 5 is an enlarged view illustrating the plate and the heat dissipation fin according to the first embodiment of the present invention.

With reference to FIG. 5, in the non-heat dissipation fin portion 210, a cut start point S may be positioned at a point corresponding to an outer diameter range A of the first junction port 130, and an outer diameter based on a direction parallel to the direction from one side to the other of the plate 100 may be applied to the outer diameter range A.

In addition, in the non-heat dissipation fin portion 210, a cut end point E may be positioned at a point corresponding to the outer diameter range A of the second junction port 140, and the outer diameter based on the direction parallel to the direction from one side to the other of the plate 100 may be applied to the outer diameter range A.

In case that an outer diameter of each of the first and second junction ports 130 and 140 is 22.4 mm, the performance analysis related to the start point S, the end point E, and a cut width B of the non-heat dissipation fin portion 210 will be described below.

As shown in Table 1, in case that the cut width B of 0.5 mm to 2.5 mm is applied when the outer diameter range A is 0 mm to 22.4 mm,

TABLE 1

Figure 10:
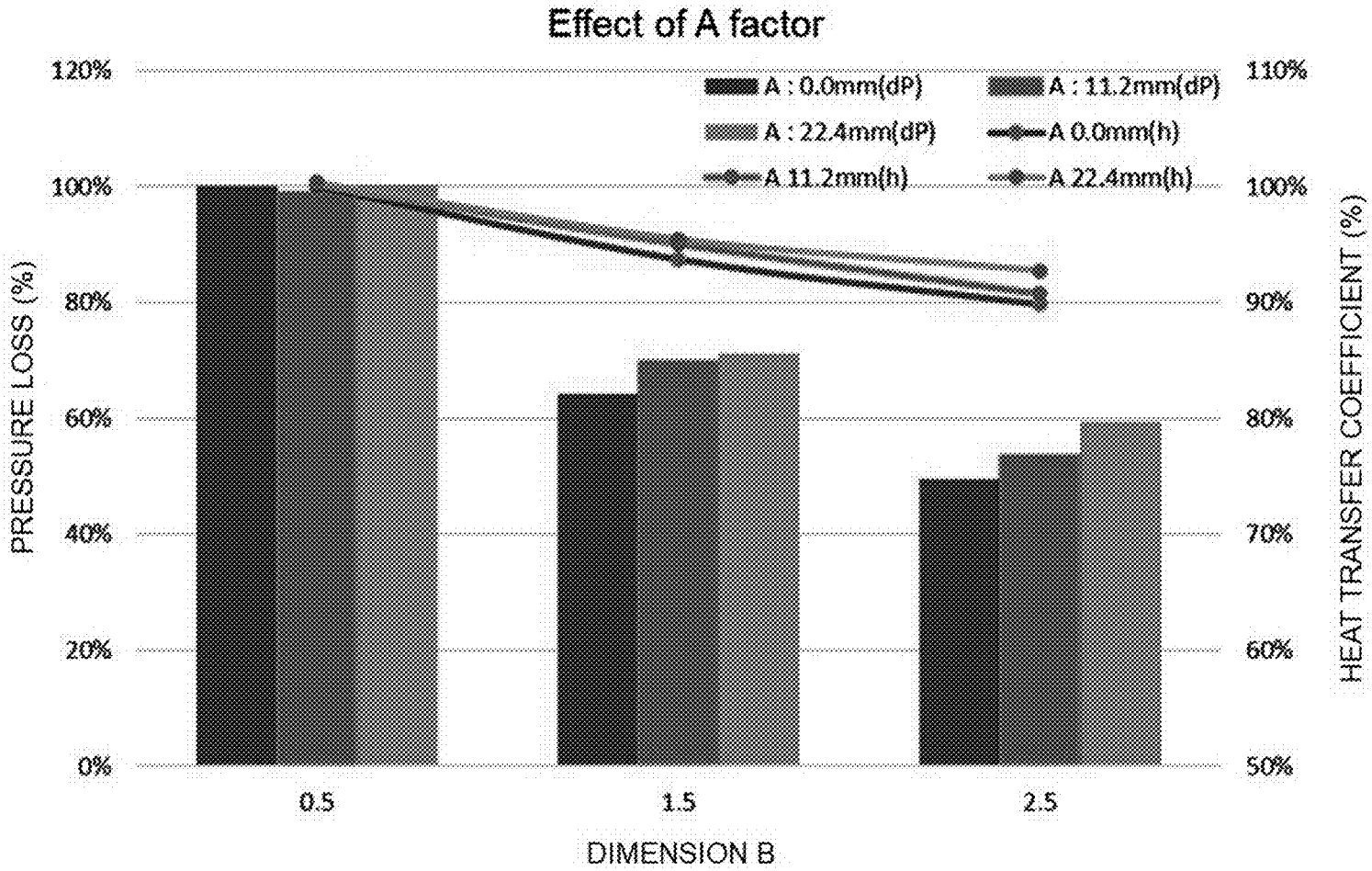
FIG. 10 illustrates pressure loss (dP) and heat transfer coefficient (h) in response to change in an outer diameter range based on a cut width.
Figure 11:
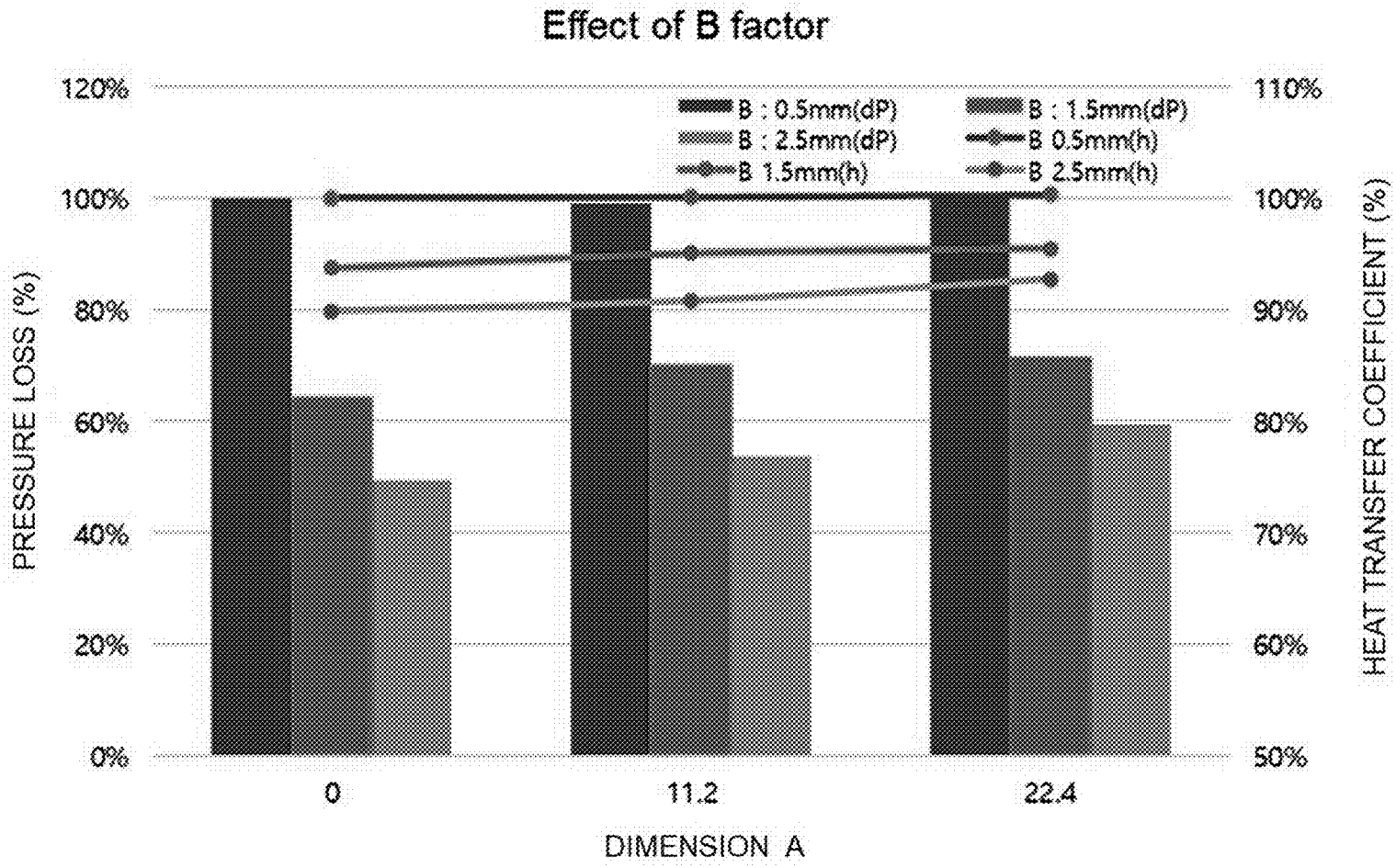
FIG. 11 illustrates pressure loss (dP) and heat transfer coefficient (h) in response to change in a cut width based on an outer diameter range.

| A(mm) | B(mm) |
|---|---|
| 0 | 0.5 |
| | 1.5 |
| | 2.5 |
| 11.2 | 0.5 |
| | 1.5 |
| | 2.5 |
| 22.4 | 0.5 |
| | 1.5 |
| | 2.5 |

the following results illustrated in FIGS. 10 and 11 may be obtained.

[FIG. 10] Pressure loss (dP) and heat transfer coefficient (h) in response to change in outer diameter range A based on cut width B.

When the cut width B increases, a pressure loss varies by about 20%, and a heat transfer coefficient varies by about 10%.

Most particularly, in consideration of the pressure loss, the heat transfer coefficient, and durability of the heat dissipation fin 200 and the plate 100, the cut start point S at the side of the first junction port 130 in the outer diameter range A may start at 22.4 mm, and the cut end point E at the side of the second junction port 140 may end at 0 mm of the second junction port 140, such that the non-heat dissipation fin portion 210 may be formed within a shortest distance range between the first junction port 130 and the second junction port 140.

Furthermore, the non-heat dissipation fin portion 210 may have a width of 1 to 1.5 mm in a direction from the edge to the inside of the heat dissipation fin 200.

[FIG. 11] Pressure loss (dP) and heat transfer coefficient (h) in response to change in cut width B based on outer diameter range A The pressure loss (dP) may be a difference in pressure of the fluid passing through the plate 100 between the inlet port 110 and the outlet port 120, and the heat transfer coefficient (h) may be a heat transfer performance coefficient of the heat exchanger including the plate 100.

When the cut width B is 1.5 mm, the pressure loss is improved by 30% or more, and the heat transfer coefficient is degraded by about 5%, in comparison with the case in which the cut width B is 0.5 mm. The deterioration in heat transfer coefficient may be reduced as the pressure loss is improved by 30% and a flow rate is increased. The heat transfer coefficient greatly deteriorates when the cut width B is 2.5 mm. Therefore, the cut width B may be at a level of 1.0 to 1.5 mm in consideration of the pressure loss, the heat transfer coefficient, and the durability of the heat dissipation fin 200 and the plate 100.

Figure 6:
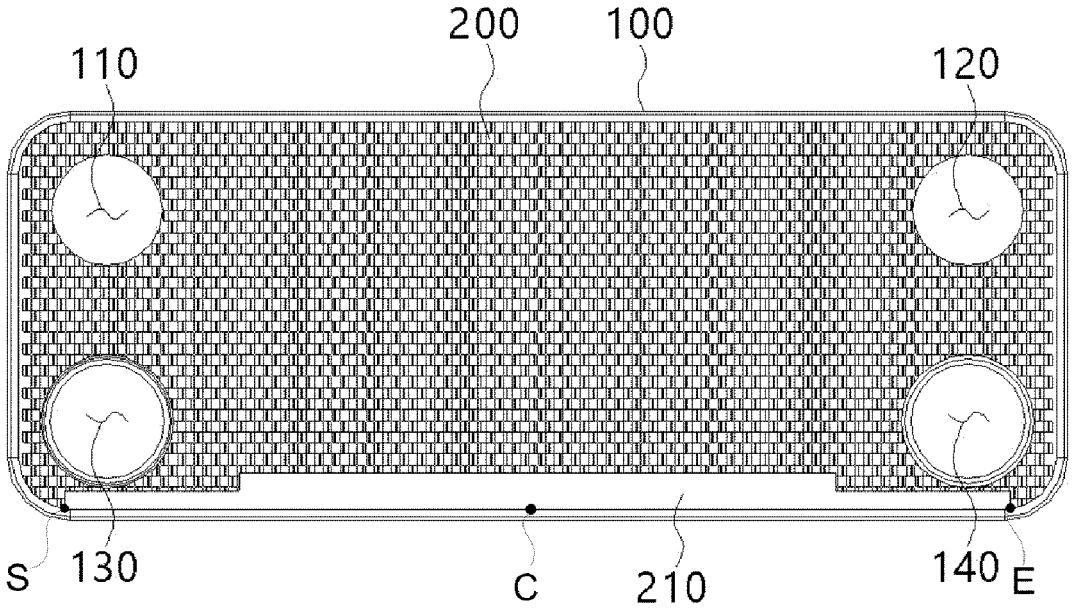
FIG. 6 is an assembled top plan view illustrating a plate and a heat dissipation fin according to a second embodiment of the present invention.
Figure 7:
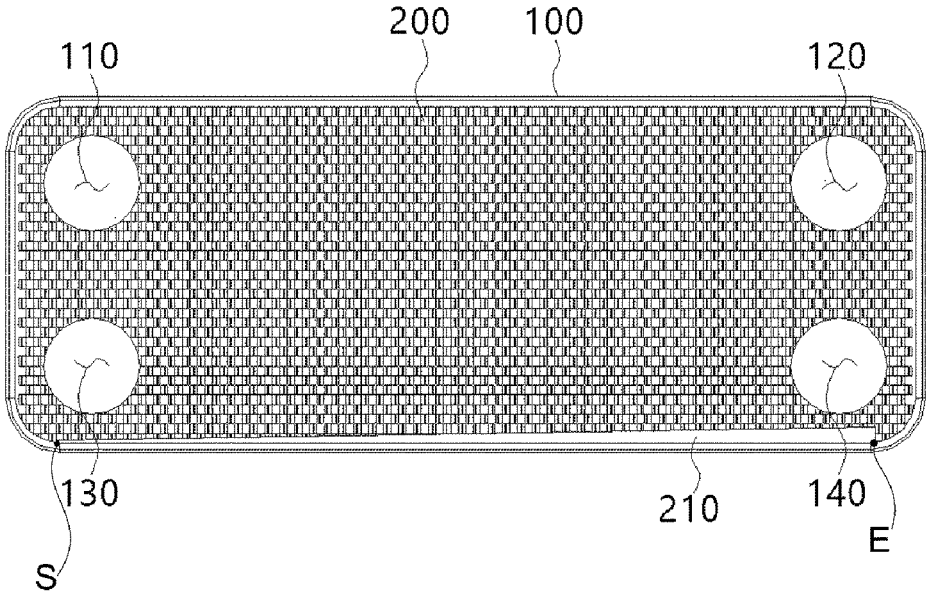
FIG. 7 is an assembled top plan view illustrating plates and heat dissipation fins according to third and fourth embodiments of the present invention.
Figure 7:
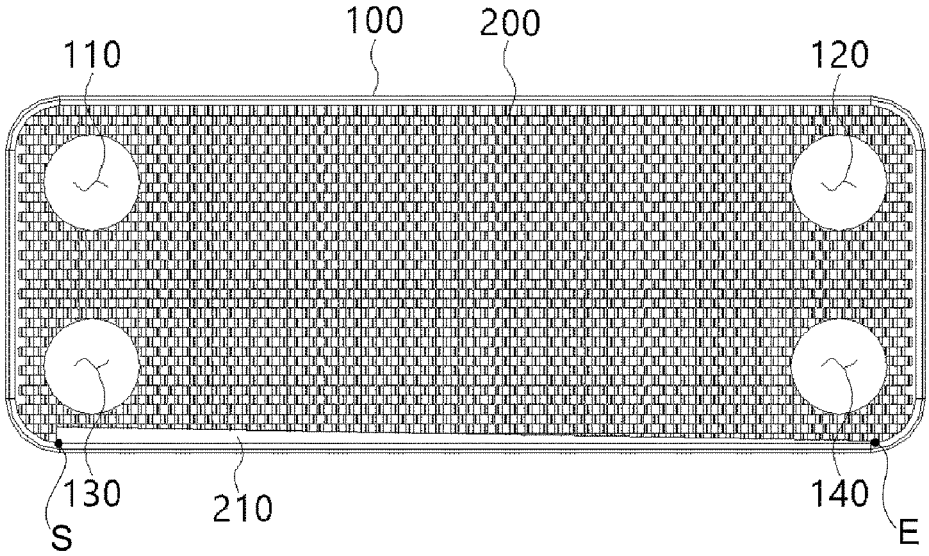

With reference to FIG. 6, in the non-heat dissipation fin portion 210, the cut width B at a central portion C may be larger than the cut width B of the cut start point S and the cut end point E. That is, the cut width B of the central portion C is larger than the cut width B of the cut start point S and the cut width B of the cut end point E of the non-heat dissipation fin portion 210, such that a deterioration in junction durability of the heat dissipation fin 200 and the plate 100 at the cut start point S and the cut end point E may be minimized, and the amount of fluid, which bypasses the heat dissipation fin 200 through the central portion C of the non-heat dissipation fin portion 210, may be increased, thereby preventing a deterioration in pressure. In this case, the non-heat dissipation fin portion 210 may have a stepped portion, as illustrated in FIG. 7. Although not illustrated, the non-heat dissipation fin portion 210 may have an arc shape.

With reference to FIGS. 7A and 7B, the cut width B of the cut start point S and the cut width B of the cut end point E may be different from each other. That is, the non-heat dissipation fin portion 210 may be shaped so as not to be symmetric horizontally or vertically by coupling durability between the non-heat dissipation fin portion 210 and the plate 100, pressure of the fluid, a flow rate distribution, a shape of the heat dissipation fin 200, and the like.

In this case, as illustrated in FIG. 7A, in the non-heat dissipation fin portion 210, the cut width B may increase in a direction from the cut start point S to the cut end point E. The non-heat dissipation fin portion 210 may have a shape in which the cut width B increases in the direction from the cut start point S to the cut end point E, thereby decreasing a bypassing fluid flow rate.

In addition, as illustrated in FIG. 7B, in the non-heat dissipation fin portion 210, the cut width B may decrease in a direction from the cut start point S to the cut end point E. The non-heat dissipation fin portion 210 may have a shape in which the cut width B decreases in the direction from the cut start point S to the cut end point E, thereby increasing a bypassing fluid flow rate.

When the non-heat dissipation fin portion 210 has a shape having a gradient, the cut start point S may be formed at a point farthest from the cut end point E within the outer diameter range A, and the cut end point E may also be formed at a point farthest from the cut start point S within the outer diameter range.

Figure 8:
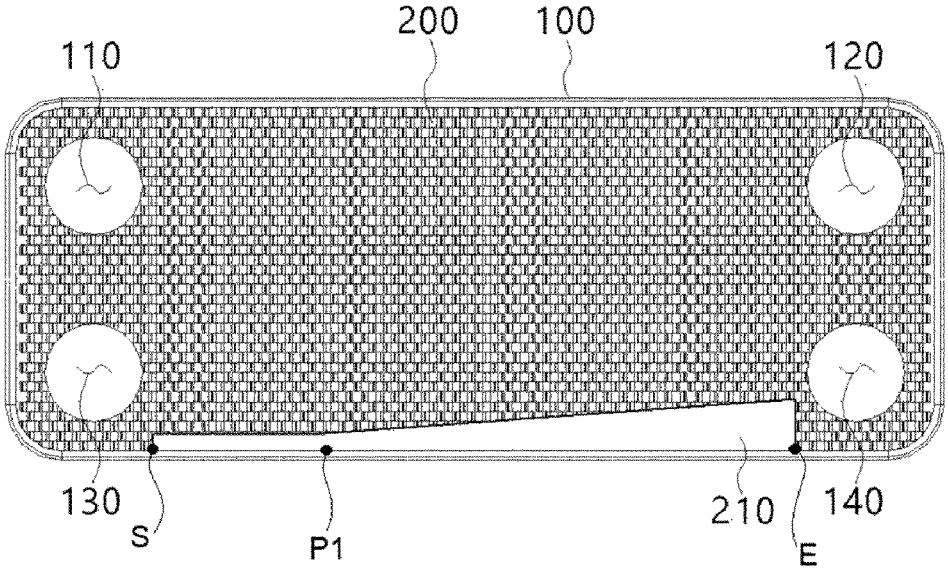
FIG. 8 is an assembled top plan view illustrating plates and heat dissipation fins according to fifth and sixth embodiments of the present invention.
Figure 8:
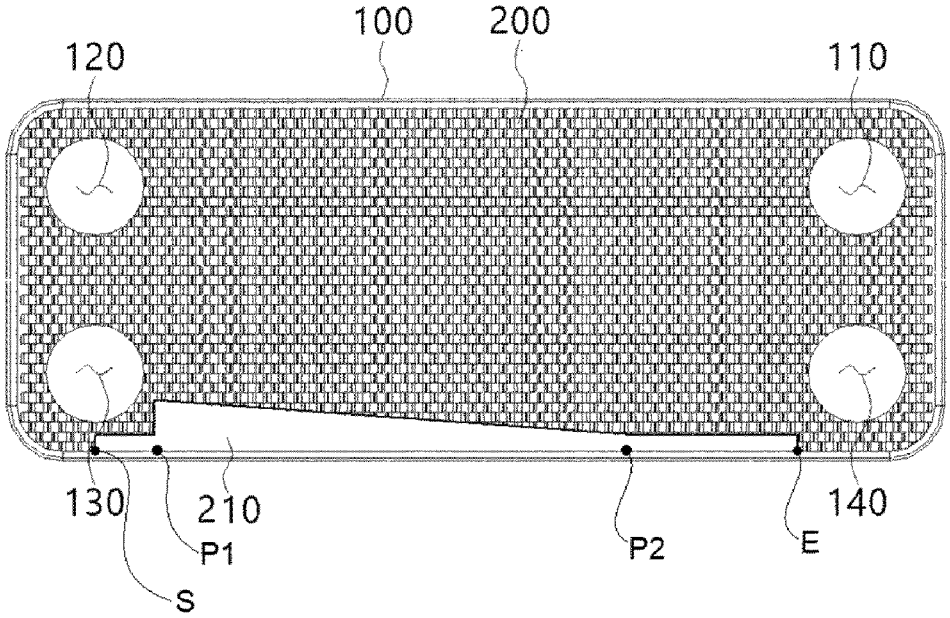

In addition, as illustrated in FIG. 8A, the non-heat dissipation fin portion 210 may have a shape in which the cut width B is constant between the cut start point S and a first point P1, and the cut width B increases in a direction from the first point P1 to the cut end point E.

In addition, as illustrated in FIG. 8B, the non-heat dissipation fin portion 210 may have a shape in which the cut width B is constant between the cut start point S and the first point P1, the cut width B increases from the first point P1, the cut width B decreases in a direction from the first point P1 to a second point P2, and the cut width B is constant between the second point P2 and the cut end point E.

Figure 9:
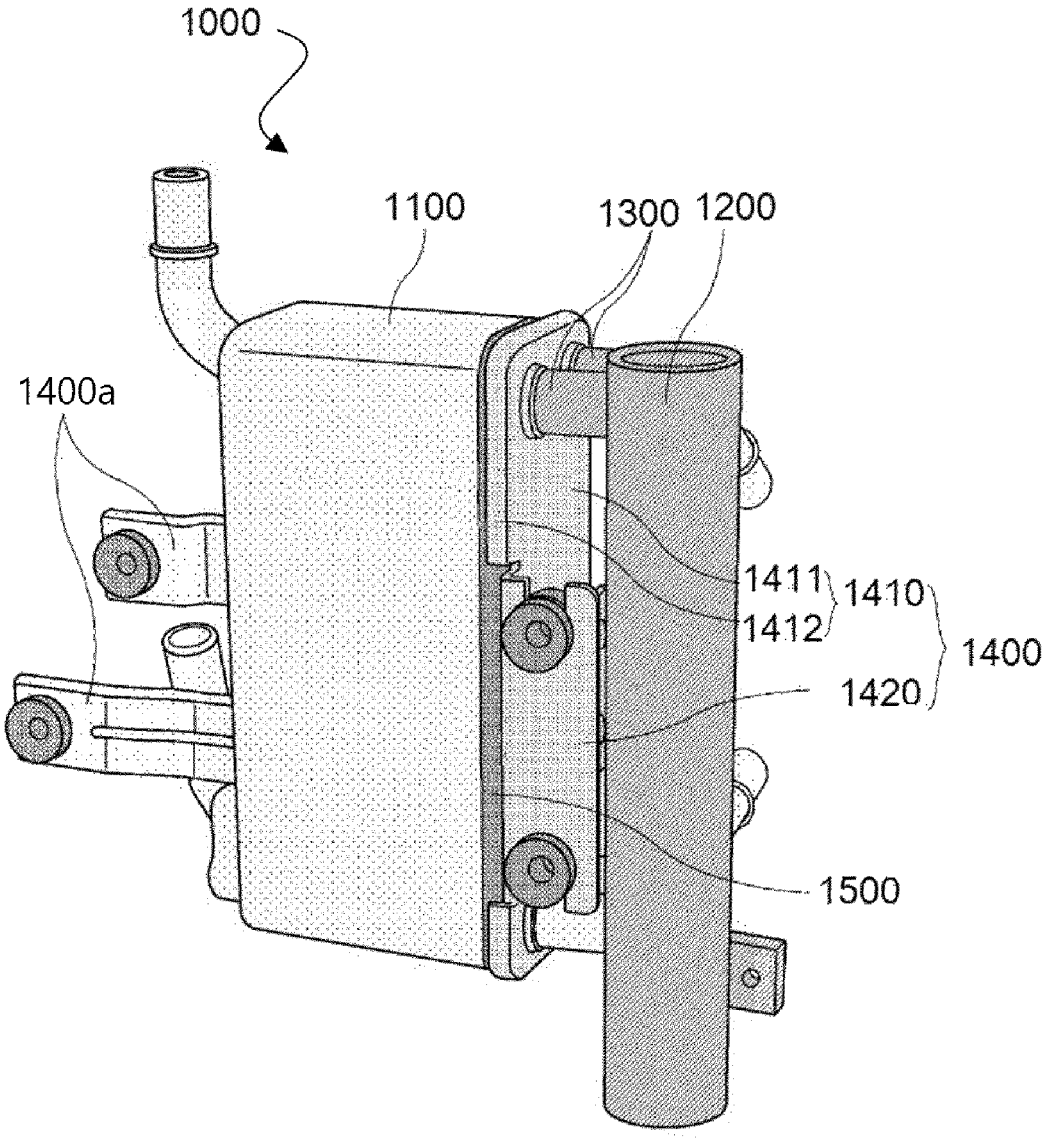
FIG. 9 is a perspective view illustrating a water-cooled condenser according to the present invention.

With reference to FIG. 9, the heat exchanger may be configured as a water-cooled condenser 1000. The water-cooled condenser 1000 according to the present invention may have a heat exchanger core 1100 in which a coolant flows. The heat exchanger may further include a connector 1300 configured to connect the heat exchanger core 1100 and a receiver dryer 1200.

The heat exchanger core 1100 may include a flow path through which the coolant flows, and a flow path through which a fluid, which is different from the coolant, flows, i.e., a flow path through which a refrigerant flows. The water-cooled condenser 1000 may further include a condensing region in which the refrigerant is condensed as the refrigerant and the coolant exchange heat with each other. In this case, the receiver dryer 1200 may separate gas and liquid from the condensed refrigerant.

The connector 1300 may connect the heat exchanger core and the receiver dryer so that the fluid flows between the heat exchanger core 1100 and the receiver dryer 1200. The water-cooled condenser 1000 may further include a supercooling region in which the refrigerant is supercooled as the coolant and the refrigerant having passed through the receiver dryer 1200 exchange heat with each other. The connector 1300 connects and fixes the heat exchanger core 1100 and the receiver dryer 1200 that form the condensing region and the supercooling region.

In addition, the heat exchanger core 1100 is fixed to an external device by a bracket plate 1400 connected to be in surface contact with one surface of the heat exchanger core 1100. The bracket plate 1400 includes a plate surface portion 1411 provided to be in surface contact with one surface of the heat exchanger core 1100, and a peripheral portion 1412 bent from an edge of the plate surface portion 1411 and provided to surround a part of a periphery of the heat exchanger core 1100. In addition, the heat exchanger core 1100 may further include a reinforcement plate 1500 disposed to be in surface contact with the plates and interposed between the plates connected to the bracket plate 1400. At least a part of the reinforcement plate 1500 is disposed to be in surface contact with a front surface of the plate.

In addition, a bracket 1400*a*, which is connected directly to the heat exchanger core 1100, may be provided at the other side of the heat exchanger core 1100 and fix the heat exchanger core 1100 to the external device.

The present invention is not limited to the above embodiments, and the scope of application is diverse. Of course, various modifications and implementations are possible without departing from the subject matter of the present invention claimed in the claims.

The invention claimed is:

1. A heat exchanger comprising:

plates each having an inlet port into which a fluid is introduced, and an outlet port from which the fluid is discharged; and a heat dissipation fin inserted between a pair of the plates, wherein the inlet port and the outlet port are formed at one side based on a width direction of the plates and spaced apart from each other in a longitudinal direction of the plates, wherein the heat dissipation fin comprises a non-heat dissipation fin portion formed at another side based on the width direction of the plates, wherein a heat exchanger core is formed by stacking the plates, wherein the plates comprise:

a first junction port having a periphery protruding upward; and a second junction port having a periphery protruding upward, wherein the first junction port and the second junction port are formed at the another side based on the width direction of the plates and spaced apart from each other in the longitudinal direction of the plates, wherein the non-heat dissipation fin portion is formed within a maximum distance range between an outer diameter of the first junction port and an outer diameter of the second junction port and positioned at an edge of the heat dissipation fin, and wherein in the non-heat dissipation fin portion, a cut width of a central portion is larger than a cut width of a cut start point and a cut width of a cut end point.

2. The heat exchanger of claim 1, wherein the non-heat dissipation fin portion is formed by cutting a part of the heat dissipation fin.

3. The heat exchanger of claim 1, wherein the heat dissipation fin has holes formed to correspond to the inlet port, the outlet port, the first junction port, and the second junction port and is seated on an upper surface of the plates.

4. The heat exchanger of claim 1, wherein the non-heat dissipation fin portion is formed to include a point farthest in distance from both the inlet port and the outlet port.

5. The heat exchanger of claim 4, wherein a cut start point of the non-heat dissipation fin portion is positioned at a point corresponding to an outer diameter range of the first junction port, and said outer diameter range is based on a direction parallel to a direction from one side to the another side of the plates.

6. The heat exchanger of claim 5, wherein a cut end point of the non-heat dissipation fin portion is positioned at a point corresponding to an outer diameter range of the second junction port, and said outer diameter range is based on a direction parallel to the direction from one side to the another side of the plates.

7. The heat exchanger of claim 1, wherein the non-heat dissipation fin portion has a width of 1 to 1.5 mm in a direction from an edge to an inside of the heat dissipation fin.

8. The heat exchanger of claim 1, wherein in the non-heat dissipation fin portion, a cut width of a cut start point and a cut width of a cut end point are different from each other.

9. The heat exchanger of claim 8, wherein in the non-heat dissipation fin portion, the cut width increases in a direction from the cut start point to the cut end point.

10. The heat exchanger of claim 8, wherein in the non-heat dissipation fin portion, the cut width decreases in a direction from the cut start point to the cut end point.

11. The heat exchanger of claim 1, wherein a coolant flows through the heat exchanger core, and wherein the heat exchanger further comprises:

a receiver dryer; and a connector configured to connect the heat exchanger core and the receiver dryer.

12. A heat exchanger comprising:

plates each having an inlet port into which a fluid is introduced, and an outlet port from which the fluid is discharged; and a heat dissipation fin inserted between a pair of the plates, wherein the inlet port and the outlet port are formed at one side based on a width direction of the plates and spaced apart from each other in a longitudinal direction of the plates, wherein the heat dissipation fin comprises a non-heat dissipation fin portion formed at another side based on the width direction of the plates, wherein a heat exchanger core is formed by stacking the plates, wherein the plates comprise:

a first junction port having a periphery protruding upward; and a second junction port having a periphery protruding upward, wherein the first junction port and the second junction port are formed at the another side based on the width direction of the plates and spaced apart from each other in the longitudinal direction of the plates, wherein the non-heat dissipation fin portion is formed within a maximum distance range between an outer diameter of the first junction port and an outer diameter of the second junction port and positioned at an edge of the heat dissipation fin, wherein in the non-heat dissipation fin portion, a cut width of a cut start point and a cut width of a cut end point are different from each other, and wherein in the non-heat dissipation fin portion, the cut width increases in a direction from the cut start point to the cut end point.

13. The heat exchanger of claim 12, wherein the non-heat dissipation fin portion is formed by cutting a part of the heat dissipation fin.

14. The heat exchanger of claim 12, wherein the heat dissipation fin has holes formed to correspond to the inlet port, the outlet port, the first junction port, and the second junction port and is seated on an upper surface of the plates.

15. The heat exchanger of claim 12, wherein the non-heat dissipation fin portion is formed to include a point farthest in distance from both the inlet port and the outlet port.

16. A heat exchanger comprising:

plates each having an inlet port into which a fluid is introduced, and an outlet port from which the fluid is discharged; and a heat dissipation fin inserted between a pair of the plates, wherein the inlet port and the outlet port are formed at the another side based on a width direction of the plates and spaced apart from each other in a longitudinal direction of the plates, wherein the heat dissipation fin comprises a non-heat dissipation fin portion formed at another side based on the width direction of the plates, wherein a heat exchanger core is formed by stacking the plates, wherein the plates comprise:

a first junction port having a periphery protruding upward; and a second junction port having a periphery protruding upward, wherein the first junction port and the second junction port are formed at one side based on the width direction of the plate and spaced apart from each other in the longitudinal direction of the plates, wherein the non-heat dissipation fin portion is formed within a maximum distance range between an outer diameter of the first junction port and an outer diameter of the second junction port and positioned at an edge of the heat dissipation fin, wherein in the non-heat dissipation fin portion, a cut width of a cut start point and a cut width of a cut end point are different from each other, and wherein in the non-heat dissipation fin portion, the cut width decreases in a direction from the cut start point to the cut end point.

17. The heat exchanger of claim 16, wherein the non-heat dissipation fin portion is formed by cutting a part of the heat dissipation fin.

18. The heat exchanger of claim 16, wherein the heat dissipation fin has holes formed to correspond to the inlet port, the outlet port, the first junction port, and the second junction port and is seated on an upper surface of the plates.

19. The heat exchanger of claim 16, wherein the non-heat dissipation fin portion is formed to include a point farthest in distance from both the inlet port and the outlet port.

* * * * *